US005379746A

United States Patent [19]

Sappington

[11] Patent Number: 5,379,746

[45] Date of Patent: Jan. 10, 1995

[54] DEVICE FOR MOUNTING A SIGHT ON AN ARCHERY BOW

[75] Inventor: Donald R. Sappington, St. Charles County, Mo.

[73] Assignee: Toxorics Manufacturing, Inc., Wentzville, Mo.

[21] Appl. No.: 91,911

[22] Filed: Jul. 16, 1993

[51] Int. Cl.[6] ..... F41B 5/00

[52] U.S. Cl. ..... 124/87; 124/86

[58] Field of Search ..... 124/86, 87; 33/265

[56] References Cited

U.S. PATENT DOCUMENTS

| | | | |
|---|---|---|---|
| 2,542,501 | 2/1951 | Fredrickson | 33/265 |
| 3,310,875 | 3/1967 | Kowalski . | |
| 3,579,839 | 5/1971 | Kowalski . | |
| 3,822,479 | 7/1974 | Kowalski . | |
| 4,020,560 | 5/1977 | Heck . | |
| 4,535,747 | 8/1985 | Kudlacek . | |
| 4,543,728 | 10/1985 | Kowalsi . | |
| 4,715,126 | 12/1987 | Holt | 33/265 |
| 4,757,614 | 7/1988 | Kudlacek . | |
| 4,761,888 | 8/1988 | Kudlacek | 33/265 |
| 4,819,611 | 4/1989 | Sappington . | |
| 4,995,166 | 2/1991 | Knemeyer . | |
| 5,001,837 | 3/1991 | Bray | 33/265 |
| 5,174,269 | 12/1992 | Sappington . | |
| 5,228,204 | 7/1993 | Khoshnood | 33/265 |

FOREIGN PATENT DOCUMENTS

| | | | |
|---|---|---|---|
| 2420736 | 11/1979 | France | 124/87 |

*Primary Examiner*—Randolph A. Reese
*Assistant Examiner*—Anthony Knight
*Attorney, Agent, or Firm*—Paul M. Denk

[57] ABSTRACT

A device for attaching an archery sight to an archery bow having a bracket member for attaching to the bow and an par member slidingly engaged in the bracket. The bar member has an elongated body portion having a generally trapezoidal cross-section and a means on one end for the attachment of any one of a plurality of archery sights. The transverse edges of the body have discrete indexing depressions formed therein. The bracket member has a generally rectangular web with a first flange on the top end having first beveled wall adjoining the web. A second flange on the bottom of the web has a movable. spring biased member operatively associated therewith. The movable member has a beveled wall opposite the first beveled wall. The two beveled walls and the web define a complementary trapezoidal shaped channel for the sliding engagement of the bar member. A spring biased detent ball with the channel engages the discrete indexing indentations on the bar member to locate the bar member in discrete positions within the channel. A rotatable screw extending through the second flange engages the movable spring biased member and urges it against the bar member to secure the bar member within the channel by a tight friction fit.

5 Claims, 2 Drawing Sheets

DEVICE FOR MOUNTING A SIGHT ON AN ARCHERY BOW

BACKGROUND OF THE INVENTION

This invention relates to a sighting device for use with an archery bow, more particularly, to an improved adjustable device for connecting any one of a plurality of archery sights to an archery bow.

There are a great variety of archery sighting devices available in the market for use with a conventional archery bow or conventional compound archery bow. The sighting devices generally relate to select aspects of sighting. For example, a sighting device may employ the use of pins that extend laterally of the bow which are adjusted to provide for a consistent degree of elevation and accommodation of wind velocity during sighting. The purpose of a sighting device is to provide consistent placement of the arrow during hunting or target shooting.

Various types of sighting devices are described in prior art patents. My U.S. Pat. No. 4,819,611 discloses a sighting device that incorporates a flexible pin assembly attached to and extending from the bow. My U.S. Pat. No. 5,174,269 discloses a sighting device having a slidable frame that holds sighting pins.

Other patents which provide adjustable sighting mechanisms of various configurations include U.S. Pat. No. 4,757,614 and U.S. Pat. No. 4,535,747 both to Kudlacek. U.S. Pat. Nos. 4,543,728; 3,822,479; 3,579,839; and 3,310,387 all to Kowalski; U.S. Pat. No. 4,995,166 to Knemeyer; and U.S. Pat. No. 4,020,560 to Heck.

Generally, the aforestated patents disclose devices that employ some sort of connecting apparatus or arm to connect the sight mechanism to the bow so as to extend the sight forward of the bow. The mounting apparatus usually consists of a bracket means that attaches to the bow, and a bar that slidably engages the bracket. The bar has a plurality of discrete holes formed therein and a screw-type means, generally a screw with a knurled end, that extends through any one of the plurality of holes and engages a threaded hole in the bracket portion. The sight device mounts on the distal end of the bar. The arrangement allows the archer to vary the distance the sight extends in front of the bow. This typical prior art type of mounting assembly is clearly shown in the aforestated U.S. Pat. Nos. 5,174,269; 4,995,116; 4,757,614; 4,543,728; 4,535,747 and 4,020,560.

There are a number of notable drawbacks with the prior art adjustable mounting devices. For example, to adjust the mounting device so as to increase the relative distance of the sight from the bow, the archer must rotate the knurled screw all the way out to disengage it from the bracket and bar holes. The bar is then slid back and forth within the mounting bracket until the sight is at a desired distance from the bow. The archer must then align the holes in the bar and bracket, reinsert the screw, and tighten the screw to hold the assembly in place. This procedure is awkward and time consuming. Moreover, this procedure cannot be performed while holding the bow in an upright position while sighting in on a target. The archer must turn the bow on its side and carefully withdraw the screw so that the sight does not completely disengage from the bow and fall on the ground.

Furthermore, the archer must carefully align the holes while the mounting arm is extended to its desired position and then reinsert the screw. This can be tedious, especially when using a device that has no alignment means, such as a detent or indexing means to provide for positive alignment of the holes.

SUMMARY OF THE INVENTION

It is, therefore, a principal-object of the present invention to provide an adjustable attachment device for attaching a sight to an archery bow in which an elongated bar, having a sight mounted on one end, slidingly engages a bracket mounted on the bow, the bar being held in place by a biased wedging means within the bracket that is urged against the bar a rotatable screw element.

Another object of the present invention is to provide an adjustable attachment device for attaching a sight to an archery bow in which the slidable bar and the bracket have a cooperating indexing means and detent means, respectively, that serve to index the positions of the bar in the bracket.

Yet another object of the present invention is to provide an adjustable attachment device for attaching a sight to an archery bow which can be easily manipulated and adjusted while the archer is sighting the bow on a target.

Briefly stated, a device for attaching an archery sight to an archery bow is provided having a bracket member for attaching to the bow a bar member slidingly engaged in the bracket member. The bar member has a generally trapezoidal cross-section. The transverse edges of the bar have discrete indexing depressions formed therein. The bar has a boss on one end for the attachment of any one of a plurality of archery sights. The bracket member has a generally rectangular web portion, a first opposed flange having a beveled wall, and a second opposed flange with a movable, spring biased beveled member operatively associated therewith. The beveled wall, the beveled member, and the web define a complementary, trapezoidal shaped channel for the sliding engagement of the bar member. A spring biased detent ball is disposed within the channel so as to engage the discrete indexing indentations on the bar member to index the bar member at discrete positions within the bracket. A rotatable screw means extends through the second flange and engages the movable, spring biased member so as to urge that member against the bar element and thereby hold the bar element in any one of the discrete positions by snug friction fit.

DESCRIPTION OF THE PREFERRED EMBODIMENT

Figure 1:
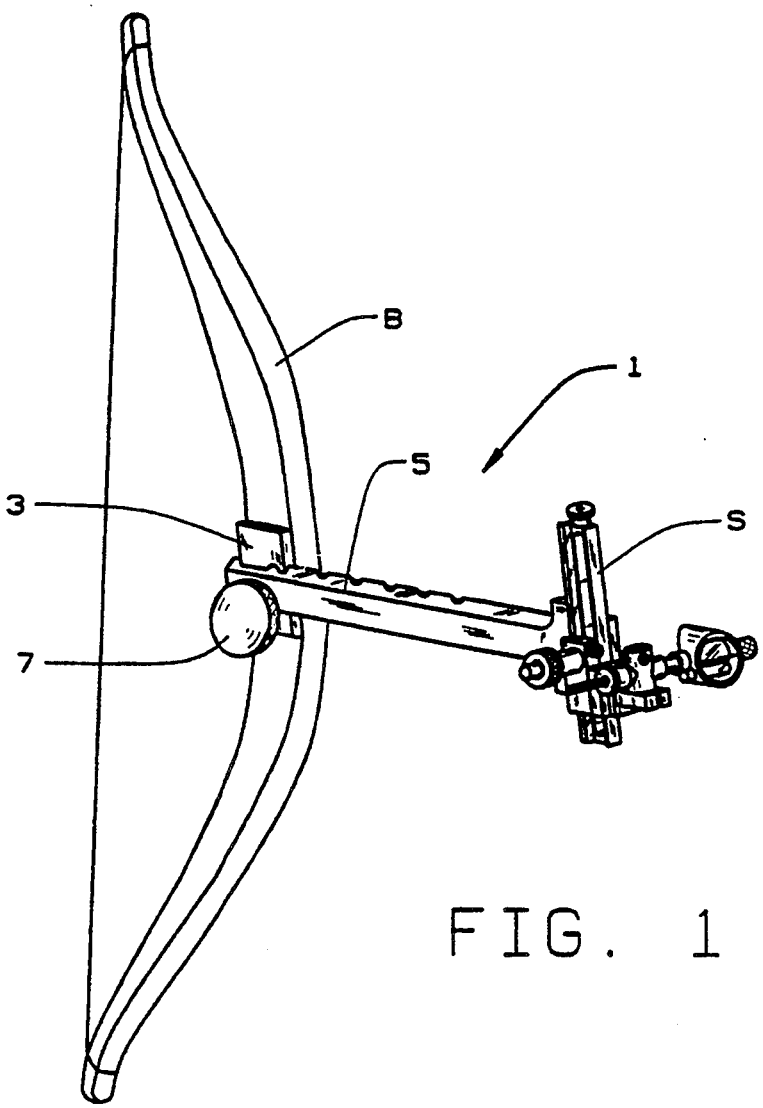
FIG. 1 is a perspective view of the archery sight mounting device of the present invention mounted on an archery bow, the bow is shown to illustrate environment.
Figure 2:
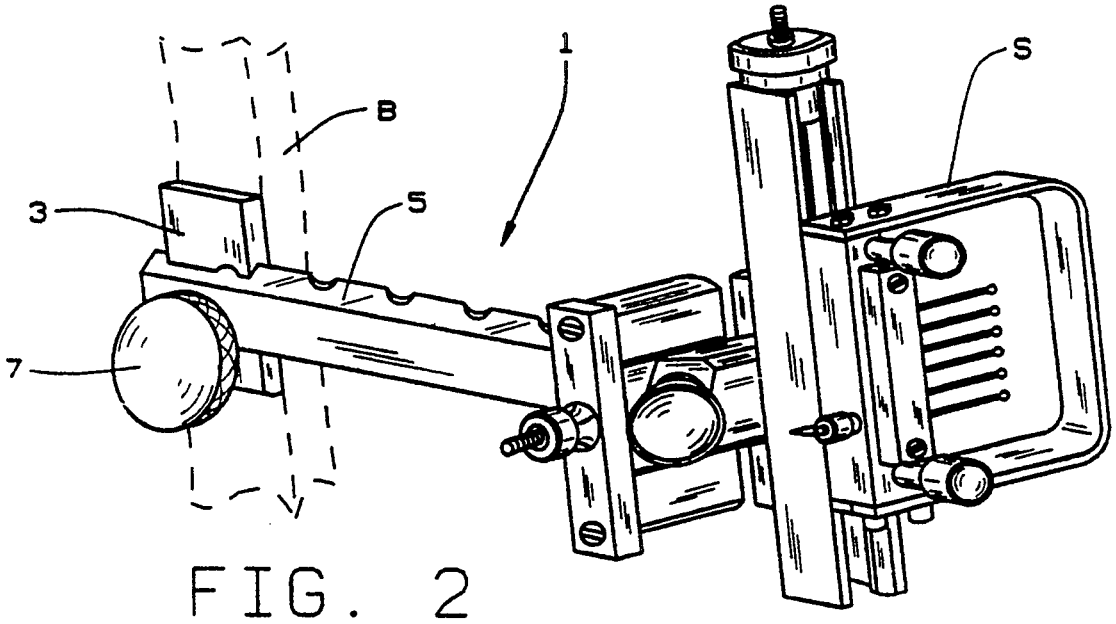
FIG. 2 is a perspective view of the archery sight mounting device of the present invention, having one alternative sight mounted thereon.
Figure 3:
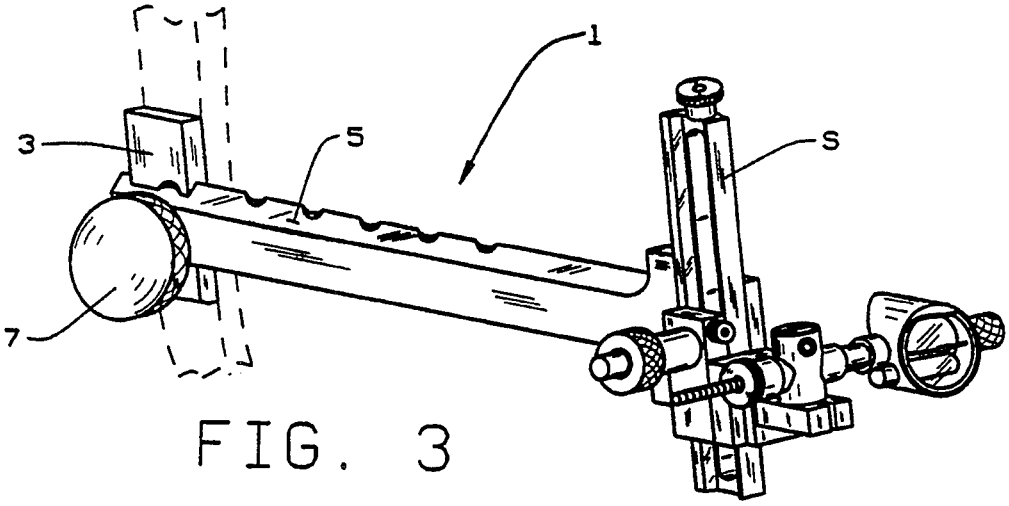
FIG. 3 is a perspective view of the archery sight mounting device of the present, having another alternative sight mounted thereon.

A device for mounting an archery sight on an archery bow of the present invention as indicated generally by reference numeral 1 in FIGS. 1–3.

Device 1 has a bracket element 3 and a bar element 5. A screw means, shown generally at 7, functions to secure the element within the bracket element. The various elements of the device of the present invention will be discussed in greater detail hereinafter.

As best illustrated in FIGS. 1–3, device 1 can be used to attach any one of a plurality of archery sights S to an archery bow B. It should be noted that any one of sights S may be attached to device 1 and thereby attached to an archery bow without departing from the scope of the present invention.

Although the device 1 including its screw means 7 is generally shown herein as affixing the bar element within its bracket element 3, from a lower segment of the said bracket, it is just as apparent that the bracket element could be inverted, so as to dispose its screw means 7 at an upper segment, and tighten the bar element 5 downwardly into a sustained fixed position within the said bracket element 3. Thus, the mechanical means for attaining the precise securement of the bar element 5 within the bracket 3 always urged into a slotted location within the bracket opposite from the operating mechanisms associated with the screw means 7, and work just as effectively either when manipulated by its screw either from the top, or the bottom, in its orientation of the bracket element 3 within the improved device of this invention.

Figure 5:
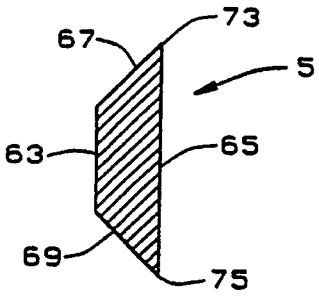
FIG. 5 is a cross section taken along lines 5—5 of FIG. 4.
Figure 6:
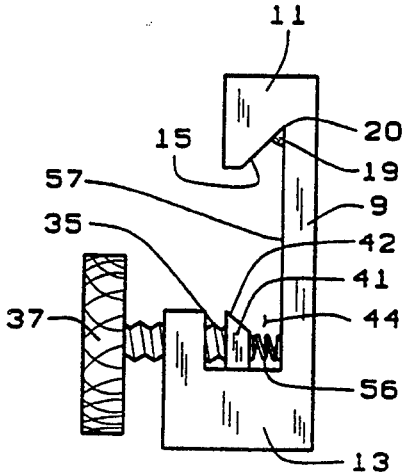
FIG. 6 is a end plan of the bracket member of the archery sight mounting device of the present invention.
Figure 4:
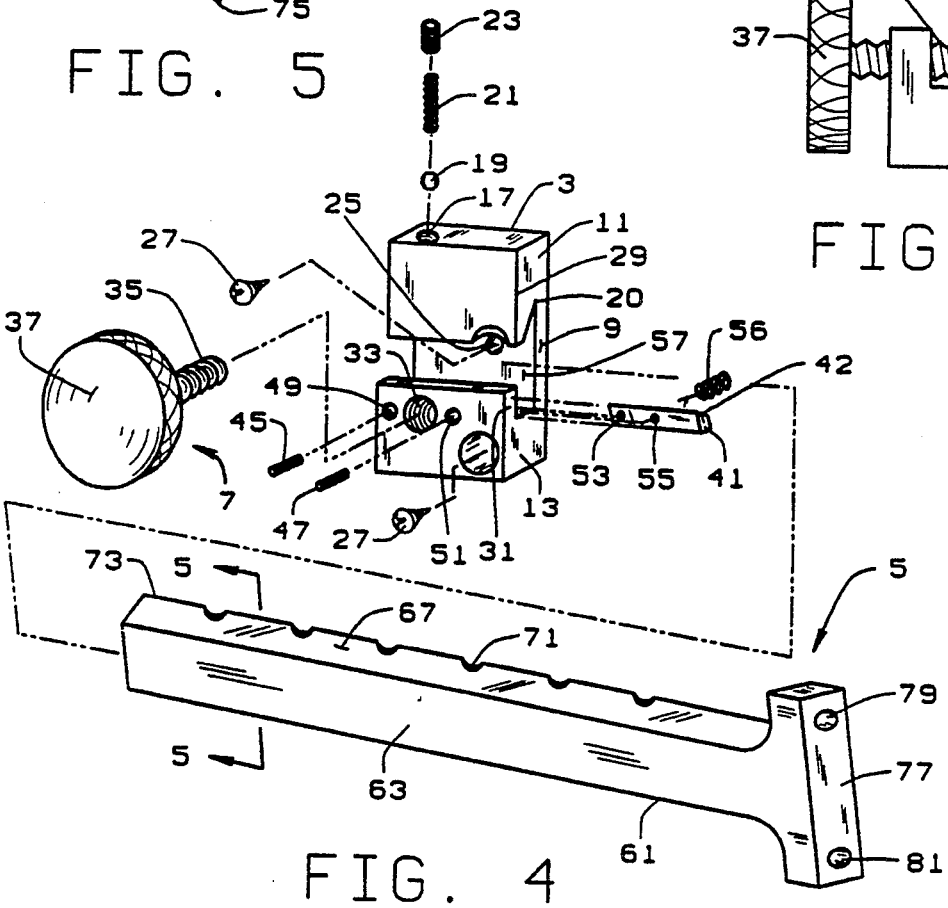
FIG. 4 is an exploded view of the archery sight mounting device of the present invention.

The details of the various elements of device 1 are best illustrated in FIGS. 4–6. Bracket member 3 has a substantially rectangular web portion 9 with a first flange 11 at the upper end and a second opposed flange 13 at the lower end. Upper flange 11 has a beveled wall 15 which slants upward toward web 9. A threaded hole 17, formed in flange 9, is slightly undersized to detent ball 19 which seats therein. Detent ball 19 is partially exposed in the angle 20 where beveled wall 15 abuts web 9. A helical bias spring 21 exerts a bias force on detent ball 21. Threaded pin 23 engages threaded hole 17 to hold ball 19 and spring 21 in position. Indention 25 formed in flange 11 allows the insertion of a screw 27 or other appropriate attachment means through hole 29 to attach bracket element 3 to the archery bow B.

Lower flange 13 has an upwardly extending boss 31 formed thereon. Boss 31 has a threaded hole 33 formed therein to engaged threaded portion 35 of tightening screw means 7. Screw 7 has a knurled knob portion 37 to facilitate gripping and turning of the screw by the user. Moveable element 41, having an upper beveled wall 43, is movably mounted in channel 44 defined by flange 13, boss 31 and web 9.

Threaded alignment pins 45 and 47 extend through threaded holes 49 and 51 formed in boss 31 and engage smooth bore holes 53 and 55, respectively, formed in member 41. Holes 53 and 55 are slightly oversized relative to pins 45 and 47 so that member 41 can move back and forth relative to the alignment pins while held in proper lateral alignment within channel 44 by said alignment pins 45 and 47. Helical bias spring 56 is positioned between member 41 and boss 31. Beveled wall 15, web 9 and beveled wall 42 define a generally trapezoidal channel 57.

As best illustrated in FIG. 6, threaded end 35 of screw means 7 abuts member 41. Screw means 7 can be rotated to move member 41 against bias spring 56 toward web 9.

The details of bar element 5 are best illustrated at FIGS. 4 and 5. Bar 5 has an elongated body portion 61 having a first side 63, a second side 65 which is somewhat greater in width than first side 63, and a pair of opposed beveled sides 67 and 69 which create a generally trapezoidal cross section complementary in shape to trapezoidal channel 57. A series of discrete, indexing indentations, as at 71, are formed on edges 73 and 75.

A transverse boss 77 formed on a terminal end of body 63 has holes 79 and 81 formed therethrough to facilitate the mounting of any one of the plurality of archery sights as previously described.

In operation, body 63 of bar 5 is slidingly engaged in channel 57. Beveled wall 41 abuts beveled wall 67. Bar 5, having a sight attached thereto at boss 77 (see FIGS. 1–3), can be positioned at any discrete position within channel 57 by sliding body 63 back and forth within channel 44. Bar 5 will stop at discrete positions when detent ball 19 is biased into one of the indentations, such as 71. When the sight S is located at a desired distance in front of bow B, screw means 7 is rotated urging member 44 against body 63. Beveled wall 41 firmly abuts beveled wall 67 thereby forcing wall 65 against web 9, tightly pinching body 63 between member 41 and web 9 to hold it snuggly in place. To adjust or change the distance of the sight S from bow B, screw means 7 is rotated in an opposite direction allowing member 41 to be biased away from body 63 by spring 56. Body 63 is slid back and forth within channel 57 between discrete positions until a desired position is found. The tightening procedure previously described is then repeated.

It may become apparent to those skilled in the art that various modifications may be made in the aforedescribed invention without departing from the scope of the appended claims. Therefore, the foregoing description of the preferred embodiment along with the accompanying drawings are intended to be illustrative and not to be interpreted in a limiting sense.

Having thus described the invention, what is claimed and desired to be secured by Letters Patent is:

1. A device for mounting a sight on an archery bow comprising:

a bracket means, said bracket means having a generally rectangular web, said web having upper and lower ends, said web having means thereon for accommodating the attaching of said bracket to a bow, said web having a first flange means at one of a lower end and upper end thereof, and a second flange means at the other of said lower and upper ends thereof, said first flange means having an integrally formed first bevelled wall bevelled inwardly towards said web means, said second flange having a movable, spring biased member operatively associated therewith, said member forming a second bevelled wall, said first bevelled wall of the web flange and said second bevelled wall of the spring biased member defining a generally trapezoidal shaped channel within said bracket means, said spring biased member capable of being adjustably shifted across said flange and towards said proximate web;

a bar member, having means on an end thereof for mounting a sight, slidingly engaged within said formed trapezoidal shaped channel, said bar means having a generally trapezoidal cross section; and, a screw means operatively associated with said second flange means and rotatably disposed therethrough so as to engage and urge said bevelled wall movable member towards the trapezoidal shaped bar member, thereby securing said bar member in fixed position once adjusted.

2. The invention of claim 1 and wherein movement said spring biased member across said flange and towards the proximate web wedging against said bar member and securing said bar member in position.

3. The invention of claim 1 and including a detent means between said first flange means bevelled wall and said web; and said bar member having discrete indexing means provided thereon for engaging said detent means so as to index said elongated bar member at discrete positions within said trapezoidal shaped channel.

4. The invention of claim 3 wherein said indexing means further comprises discrete notches formed on an edge said elongated bar member.

5. The invention of claim 3 wherein said detent means further comprises a spring biased detent ball within said channel.

* * * * *

UNITED STATES PATENT AND TRADEMARK OFFICE

CERTIFICATE OF CORRECTION

PATENT NO. : 5,379,746

DATED : January 10, 1995

INVENTOR(S) : Donald R. Sappington

It is certified that error appears in the above-identified patent and that said Letters Patent is hereby corrected as shown below:

On the title page: Item [73]

change name of Assignee from "Toxorics" to ---Toxonics---.

Abstract, line 3, change "par" to ---bar---.

Column 6, claim 4, line 10, insert after "edge" and before "said", ---of---.

Signed and Sealed this

Twenty-ninth Day of August, 1995

*Attest:*

Bruce Lehman

BRUCE LEHMAN

*Attesting Officer*

*Commissioner of Patents and Trademarks*